US011668289B2

(12) United States Patent
Chang et al.

(10) Patent No.: US 11,668,289 B2
(45) Date of Patent: Jun. 6, 2023

(54) FRACTURING APPARATUS

(71) Applicant: YANTAI JEREH PETROLEUM EQUIPMENT & TECHNOLOGIES CO., LTD., Yantai (CN)

(72) Inventors: Sheng Chang, Yantai (CN); Shuzhen Cui, Yantai (CN); Liang Lv, Yantai (CN); Jifeng Zhong, Yantai (CN); Shanwu Fu, Yantai (CN); Chunqiang Lan, Yantai (CN); Ruijie Du, Yantai (CN); Jian Zhang, Yantai (CN)

(73) Assignee: YANTAI JEREH PETROLEUM EQUIPMENT & TECHNOLOGIES CO., LTD., Yantai (CN)

( * ) Notice: Subject to any disclaimer, the term of this patent is extended or adjusted under 35 U.S.C. 154(b) by 0 days.

(21) Appl. No.: 17/743,267

(22) Filed: May 12, 2022

(65) Prior Publication Data

US 2022/0364453 A1 Nov. 17, 2022

Related U.S. Application Data

(63) Continuation of application No. PCT/CN2022/070479, filed on Jan. 6, 2022.

(30) Foreign Application Priority Data

May 12, 2021 (CN) ..... 202121008278.5

(51) Int. Cl.

| | |
|---|---|
| ***F04B 1/34*** | (2006.01) |
| ***F04B 49/10*** | (2006.01) |
| ***F04B 53/18*** | (2006.01) |
| ***F04B 17/03*** | (2006.01) |
| ***F04B 53/08*** | (2006.01) |
| ***F04B 15/02*** | (2006.01) |
| *E21B 43/26* | (2006.01) |
| *F04B 1/053* | (2020.01) |

(52) U.S. Cl.

CPC ..... *F04B 1/34* (2013.01); *F04B 15/02* (2013.01); *F04B 17/03* (2013.01); *F04B 49/10* (2013.01);

(Continued)

(58) Field of Classification Search

CPC .. F04B 1/34; F04B 1/053; F04B 15/02; F04B 17/03; F04B 49/10; F04B 53/08;

(Continued)

(56) References Cited

U.S. PATENT DOCUMENTS 11,209,124 B2 * 12/2021 Wagner ..... F04B 23/02
2002/0172604 A1 * 11/2002 Berger ..... F01M 1/16 417/307

(Continued)

FOREIGN PATENT DOCUMENTS

CN 107327686 A 11/2017
CN 110485984 A 11/2019

(Continued)

*Primary Examiner* — Charles G Freay

(57) ABSTRACT

A fracturing apparatus is provided. The fracturing apparatus includes: a plunger pump including a hydraulic end and a power end, the power end having a power end oil outlet and at least one power end oil inlet that are coupled to each other; and a power end lubricating system, including: a lubricating oil tank configured for defining an accommodation space, at least one lubrication pump having a lubrication pump oil inlet and a lubrication pump oil outlet that are coupled to each other, and at least one lubrication motor configured for providing power for the at least one lubrication pump, wherein at least a portion of at least one of the lubrication motor and the lubrication pump is located in the accommodation space.

19 Claims, 4 Drawing Sheets

(52) U.S. Cl.
CPC ..... *F04B 53/08* (2013.01); *F04B 53/18* (2013.01); *E21B 43/2607* (2020.05); *F04B 1/053* (2013.01)

(58) Field of Classification Search
CPC ..... F04B 53/18; E21B 43/2607; F16N 7/38; F16N 39/02
See application file for complete search history.

(56) References Cited

U.S. PATENT DOCUMENTS

2012/0272764 A1* 11/2012 Pendleton ..... F04B 15/02 74/425
2020/0208776 A1 7/2020 Bayyouk
2020/0332788 A1* 10/2020 Cui ..... F04B 1/00

FOREIGN PATENT DOCUMENTS

| | | | | |
|---|---|---|---|---|
| CN | 110608028 | A | | 12/2019 |
| CN | 110645156 | A | | 1/2020 |
| CN | 210049880 | U | | 2/2020 |
| CN | 111188763 | A | | 5/2020 |
| CN | 111441923 | A | | 7/2020 |
| CN | 111502970 | A | | 8/2020 |
| CN | 112160904 | A | | 1/2021 |
| CN | 112323406 | A | | 2/2021 |
| CN | 112780245 | A | | 5/2021 |
| CN | 215111965 | U | | 12/2021 |
| EP | 0257879 | | * | 6/1987 |
| WO | WO 2019/046680 | A1 | * | 3/2019 |

* cited by examiner

FRACTURING APPARATUS

CROSS-REFERENCE OF RELATED APPLICATIONS

This application claims priority to Chinese patent application No. 202121008278.5, filed on May 12, 2021. This application is a continuation application of International Application No. PCT/CN2022/070479, filed on Jan. 6, 2022. The International Application No. PCT/CN2022/070479 claims priority to the Chinese patent application No. 202121008278.5. The contents of all of the above-identified applications are incorporated herein by reference in their entirety.

TECHNICAL FIELD

Embodiments of the present disclosure relate to a fracturing apparatus.

BACKGROUND

At present, unconventional oil and gas energy sources such as shale gas are being developed increasingly. Accordingly, it is desirable to provide a fracturing apparatus to fracture the strata to form cracks for increasing oil and gas production.

SUMMARY

According to some embodiments of the present disclosure, a fracturing apparatus is provided. The fracturing apparatus includes a plunger pump that includes a hydraulic end and a power end, the power end having a power end oil outlet and at least one power end oil inlet that are coupled to each other; and a power end lubricating system that includes: a lubricating oil tank defining an accommodation space, at least one lubrication pump having a lubrication pump oil inlet and a lubrication pump oil outlet that are coupled to each other, and at least one lubrication motor configured for providing power for the at least one lubrication pump. The lubrication pump oil inlet is coupled to the accommodation space of the lubricating oil tank, the power end oil outlet is coupled to the accommodation space of the lubricating oil tank through an oil return pipeline, the lubrication pump oil outlet of the at least one lubrication pump is coupled to the at least one power end oil inlet through at least one oil inlet pipeline, and at least a portion of at least one of the lubrication motor and the lubrication pump is located in the accommodation space.

In an example, at least a portion of at least one of the lubrication motor and the lubrication pump is located in the accommodation space.

In an example, the lubrication pump oil inlet of the lubrication pump is directly exposed in the accommodation space of the lubricating oil tank.

In an example, the power end lubricating system further includes at least one transmission device configured for connecting the at least one lubrication motor to the at least one lubrication pump, and at least a portion of the at least one transmission device is located in the accommodation space.

In an example, the accommodation space of the lubricating oil tank is configured for accommodating (e.g., storing) lubricating oil therein, and the at least one lubrication motor is configured to drive the at least one lubrication pump to deliver the lubricating oil to the power end through the at least one oil inlet pipeline.

In an example, at least a portion of the at least one lubrication pump is immersed in the lubricating oil of the lubricating oil tank.

In an example, the lubrication pump oil inlet of the at least one lubrication pump is completely immersed in the lubricating oil of the lubricating oil tank.

In an example, the fracturing apparatus further includes: a prime mover, connected to the power end and configured to provide power for the power end; and a control system, connected to both the prime mover and the power end lubricating system.

In an example, the prime mover is an electric motor.

In an example, the plunger pump further includes: a first reducer and a second reducer that are connected to the power end, and one of the first reducer and the second reducer is a worm gear reducer, while the other one of the first reducer and the second reducer is a parallel reducer or a planetary reducer.

In an example, the first reducer and the second reducer are located on a same side of the power end, and the other one of the first reducer and the second reducer is located between the power end and the one of the first reducer and the second reducer.

In an example, the fracturing apparatus further includes: a temperature detector disposed on any one of the oil return pipeline, the power end oil outlet, and the lubricating oil tank and configured for detecting a temperature of the lubricating oil flowing from the power end into the oil return pipeline, wherein the control system is connected to the temperature detector and configured to control the at least one lubrication motor to keep on operating in a case where the plunger pump stops operating and the temperature detected by the temperature detector is greater than a first preset value.

In an example, the fracturing apparatus further includes: an alarm and at least one filter disposed on the at least one oil inlet pipeline, wherein the control system is connected to the at least one filter and the alarm and configured to send an alarm in a case where a pressure difference across a filter core of the at least one filter is greater than a second preset value.

In an example, the control system is configured to control the plunger pump to stop operating in a case where the temperature detected by the temperature detector is greater than the first preset value and that the alarm sends the alarm.

In an example, the at least one lubrication pump includes a first lubrication pump and a second lubrication pump; the at least one oil inlet pipeline includes a first oil inlet pipeline and a second oil inlet pipeline; the at least one power end oil inlet includes a first power end oil inlet and a second power end oil inlet; the first oil inlet pipeline is coupled to the lubrication pump oil outlet of the first lubrication pump and the first power end oil inlet; the second oil inlet pipeline is coupled to both the lubrication pump oil outlet of the second lubrication pump and the second power end oil inlet; and the first lubrication pump and the second lubrication pump are configured to allow a lubricating oil pressure in the first oil inlet pipeline to be different from a lubricating oil pressure in the second oil inlet pipeline.

In an example, the fracturing apparatus further includes: at least one oil pressure detector and at least one heat dissipator, wherein the at least one oil pressure detector is disposed on the at least one oil inlet pipeline or the at least one power end oil inlet and configured to detect the lubricating oil pressure in the at least one oil inlet pipeline, and the at least one heat dissipator is disposed on the at least one oil inlet pipeline and configured to cool the lubricating oil in the at least one oil inlet pipeline, wherein the control system is connected to the at least one oil pressure detector and the at least one heat dissipator and configured to control a speed of the at least one lubrication motor according to a value of the lubricating oil pressure detected by the at least one oil pressure detector and control a heat dissipation power of the at least one heat dissipator according to a value of the temperature detected by the temperature detector.

BRIEF DESCRIPTION OF THE DRAWINGS

In order to clearly illustrate the technical solution of the embodiments of the disclosure, the drawings of the embodiments will be briefly described in the following. The described drawings are related to some embodiments of the disclosure and thus are not limitative of the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present disclosure, are not intended to indicate any sequence, amount or importance, but distinguish various components. The terms "comprises," "comprising," "includes," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

In some embodiments of the present disclosure, a fracturing apparatus includes: a plunger pump including a hydraulic end and a power end, the power end having at least one power end oil inlet and a power end oil outlet that are coupled to each other. The fracturing apparatus further includes a power end lubricating system that includes: a lubricating oil tank configured for defining an accommodation space, at least one lubrication pump having a lubrication pump oil inlet and a lubrication pump oil outlet that are coupled to each other, and at least one lubrication motor configured for providing power for the at least one lubrication pump. The lubrication pump oil inlet is coupled to the accommodation space. The power end oil outlet is coupled to the lubricating oil tank through an oil return pipeline. The lubrication pump oil outlet of the at least one lubrication pump is coupled to the at least one power end oil inlet through at least one oil inlet pipeline. At least a portion of the lubrication motor and/or the lubrication pump is located in the accommodation space.

With this configuration, the noise produced during the working process of the power end lubricating system can be effectively reduced.

Figure 1:
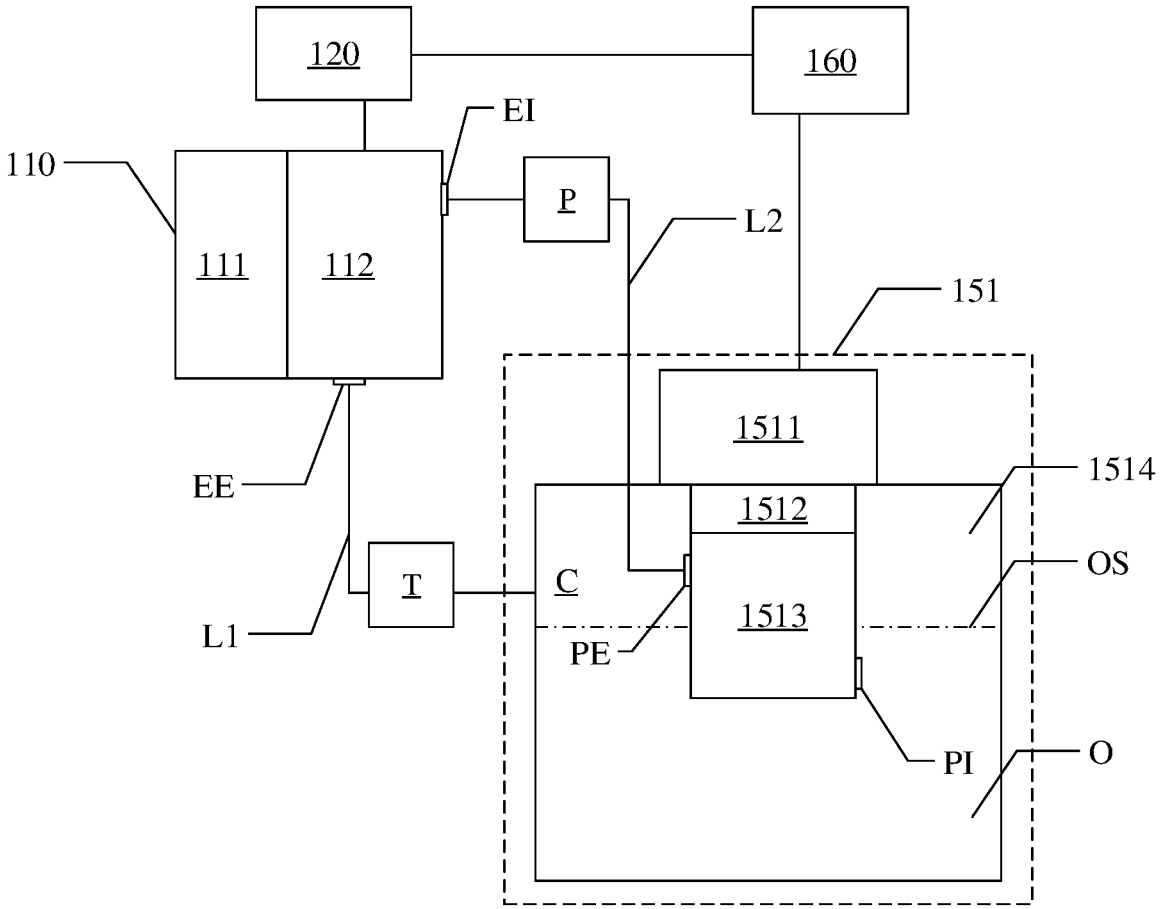
FIG. 1 is a schematic block diagram of a fracturing apparatus according to some embodiments of the present disclosure.

FIG. 1 is a schematic block diagram of a fracturing apparatus according to an embodiment of the present disclosure.

Referring to FIG. 1, the fracturing apparatus includes a plunger pump 110 and a power end lubricating system 151. The plunger pump 110 includes a hydraulic end 111 and a power end 112. The power end 112 has a power end oil outlet EE and a power end oil inlet EI that are coupled to each other. For example, to be coupled to each other, EE and EI are connected directly or indirectly such that a fluid may flow from EE to EI or from EI to EE.

The power end lubricating system 151 includes a lubricating oil tank 1514, a lubrication pump 1513, and a lubrication motor 1511.

The lubricating oil tank 1514 defines an accommodation space C.

The lubrication pump 1513 has a lubrication pump oil inlet PI and a lubrication pump oil outlet PE that are coupled to each other.

The lubrication motor 1511 provides power for the lubrication pump 1513. The lubrication pump oil inlet PI is coupled to the accommodation space C, and the power end oil outlet EE is coupled to the accommodation space C of the lubricating oil tank 1514 through an oil return pipeline L1. The lubrication pump oil outlet PE of the lubrication pump 1513 is coupled to the power end oil inlet EI through an oil inlet pipeline L2.

In the example shown in FIG. 1, the lubrication motor 1511 is located outside the accommodation space C of the lubricating oil tank 1514, and the lubrication pump 1513 is located in the accommodation space.

In another example, the lubrication motor 1511 and the lubrication pump 1513 are completely located in the accommodation space C of the lubricating oil tank 1514.

In still another example, a portion of the lubrication motor 1511 and the entire lubrication pump 1513 are located in the accommodation space C of the lubricating oil tank 1514.

In still another example, a portion of the lubrication motor 1511 and a portion of the lubrication pump 1513 are located in the accommodation space C of the lubricating oil tank 1514.

In other words, at least a portion of at least one of the lubrication motor 1511 and the lubrication pump 1513 is located in the accommodation space.

With this configuration, the lubricating oil tank 1514 impedes the propagation of noise produced during the working process of at least one of the lubrication motor 1511 and the lubrication pump 1513 that are at least partially located in the lubricating oil tank, thereby realizing noise reduction during the working process of the power end lubricating system 151.

Referring continuously to FIG. 1, the lubrication pump oil inlet PI of the lubrication pump 1513 is directly exposed in the accommodation space C of the lubricating oil tank 1514. In other words, the coupling between the lubrication pump oil inlet PI of the lubrication pump 1513 and the accommodation space C of the lubricating oil tank 1514 does not rely on any pipeline.

The power end lubricating system 151 for example further includes a transmission device 1512 for connecting the lubrication motor 1511 to the lubrication pump 1513. In the example shown in FIG. 1, the transmission device 1512 is completely located in the accommodation space C of the lubricating oil tank 1514. In another example, the transmission device 1512 is partially located in the accommodation space C of the lubricating oil tank 1514 or completely located outside the accommodation space C of the lubricating oil tank 1514.

The transmission device 1512 in FIG. 1 may be omitted. In other words, the lubrication motor 1511 and the lubrication pump 1513 may be directly connected to each other.

For example, the accommodation space C of the lubricating oil tank 1514 accommodates a lubricating oil 0 therein. The lubrication motor 1511 is configured to drive the lubrication pump 1513 to deliver the lubricating oil 0 to the power end via at least one oil inlet pipeline.

For example, at least a portion of the lubrication pump 1513 is immersed in the lubricating oil 0. With this configuration, the lubricating oil 0 in the lubricating oil tank 1514 further impedes the propagation of noise during the working process of the lubrication pump 1513, thereby further reducing the noise during the working process of the power end lubricating system 151.

For example, the lubrication pump oil inlet PI of the lubrication pump 1513 is completely immersed in the lubricating oil 0. In other words, the lubrication pump oil inlet PI of the lubrication pump 1513 is completely located below a surface OS of the lubricating oil 0. With this configuration, the lubricating oil can enter the lubrication pump 1513 directly through the lubrication pump oil inlet PI of the lubrication pump 1513 and be pumped out from the lubrication pump oil outlet PE of the lubrication pump 1513. In this way, an oil pipeline for connecting the lubrication pump oil inlet PI with the lubricating oil in the accommodation space C of the lubricating oil tank 1514 can be obviated.

The embodiments of the present disclosure have no particular limitation on whether oil suction pipeline is connected to the lubrication pump oil inlet PI of the lubrication pump 1513. In another example, an end of the oil suction pipeline (not shown) is connected to the lubrication pump oil inlet PI of the lubrication pump 1513, and the other end of the oil suction pipeline opposite to the end extends into the lubricating oil 0. The oil suction pipeline may be located completely or partially in the accommodation space C of the lubricating oil tank 1514.

Referring to FIG. 1, the fracturing apparatus according to the embodiment of the present disclosure further includes a prime mover 120 and a control system 160.

The prime mover 120 is connected to the power end 112 of the plunger pump 110 and configured to provide power for the power end 112.

The control system 160 is connected to the prime mover 120 and the power end lubricating system 151. The connection between the control system 160 and various devices may be realized in a wire or wireless communication mode. In FIG. 1, all the connections between the control system 160 and various devices are not shown by lines. In addition, the control system 160 provided herein may include a plurality of separate parts or may be in an integrated form, which will not be particularly limited in the embodiments of the present disclosure.

Referring to FIG. 1, the fracturing apparatus provided in the embodiment of the present disclosure further includes a temperature detector T disposed on the oil return pipeline L1 and configured to detect the temperature of the lubricating oil flowing from the power end 112 into the oil return pipeline L1.

The control system 160 is connected to the temperature detector T and configured to control the lubrication motor 1511 to keep on operating in the case where the plunger pump 110 stops operating and the temperature detected by the temperature detector T is greater than a first preset value.

With this configuration, in the case where the plunger pump stops operating, the control system may delay stopping the lubrication pump. If the temperature of the lubricating oil exceeds the first preset value, the lubricating oil heat dissipator keeps on operating, and after the temperature of the lubricating oil is lower than the first preset value, the lubrication pump and the lubricating oil heat dissipator stops operating.

Figure 2:
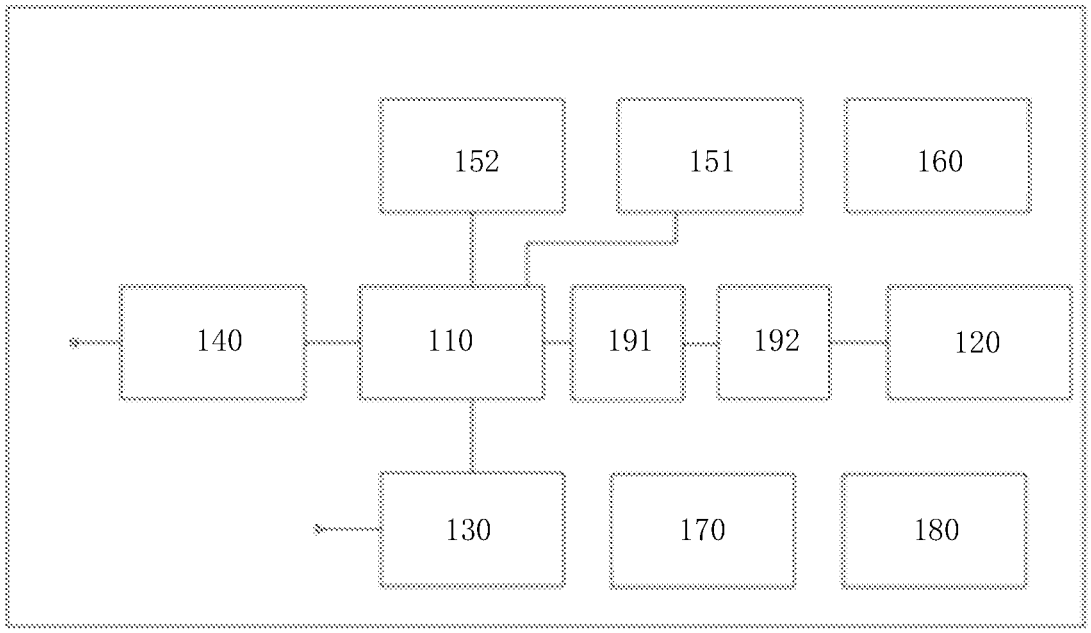
FIG. 2 is a schematic block diagram of a fracturing apparatus with a diesel engine for driving a plunger pump according to some embodiments of the present disclosure.

FIG. 2 is a schematic block diagram of a fracturing apparatus with a diesel engine for driving a plunger pump according to an embodiment of the present disclosure.

For example, referring to FIG. 2, the prime mover 120 is, for example, a diesel engine. The diesel engine is connected to a gearbox 192 and drives the plunger pump 110 to work through a transmission shaft 191. Here, the diesel engine serves as a power source, while the gearbox 192 and the transmission shaft 191 serve as a transmission device, and the plunger pump 110 serves as an actuator. In addition, the fracturing apparatus further includes a high-pressure manifold system 140, a low-pressure manifold system 130, a hydraulic end lubricating system 152, and a power end lubricating system 151.

The fracturing apparatus with the diesel engine has the following disadvantages. (1) Large overall size and heavy weight: the diesel engine is mostly provided with 12 cylinders or 16 cylinders and thus has a large size; in order to regulate the output flow of the apparatus, the engine is equipped with a gearbox to regulate the rotating speed, resulting in large overall size and great weight of the whole apparatus, inconvenience for transportation, and low power density of the apparatus. (2) Non-environmental-friendly operation: the diesel engine may cause exhaust pollution during the operating process and produce high operating noise (up to 115 dB or higher), which will affect the lives of residents around. (3) High operating cost: the diesel engine and the gearbox need to be imported from abroad, leading to high procurement cost. The engine and the gearbox need to be maintained in time during the operating process, leading to high maintenance cost. The fuel consumption cost of the unit is high.

Moreover, in the fracturing apparatus with the diesel engine, the diesel engine serves as the power source and needs to be equipped with the associated gearbox 192

(configured to regulate the input rotating speed of the plunger pump and regulate the output flow of the apparatus), a cooling system 170 (configured to cool the oil or fluid of the engine, the gearbox, a hydraulic system, etc.), and a hydraulic starting system 180 (configured to start the diesel engine and drive hydraulic components such as a fan and a hydraulic motor), thereby involving numerous components in the system, leading to a high risk of failure, and increasing the difficulty of collaborative operation of systems.

Figure 3:
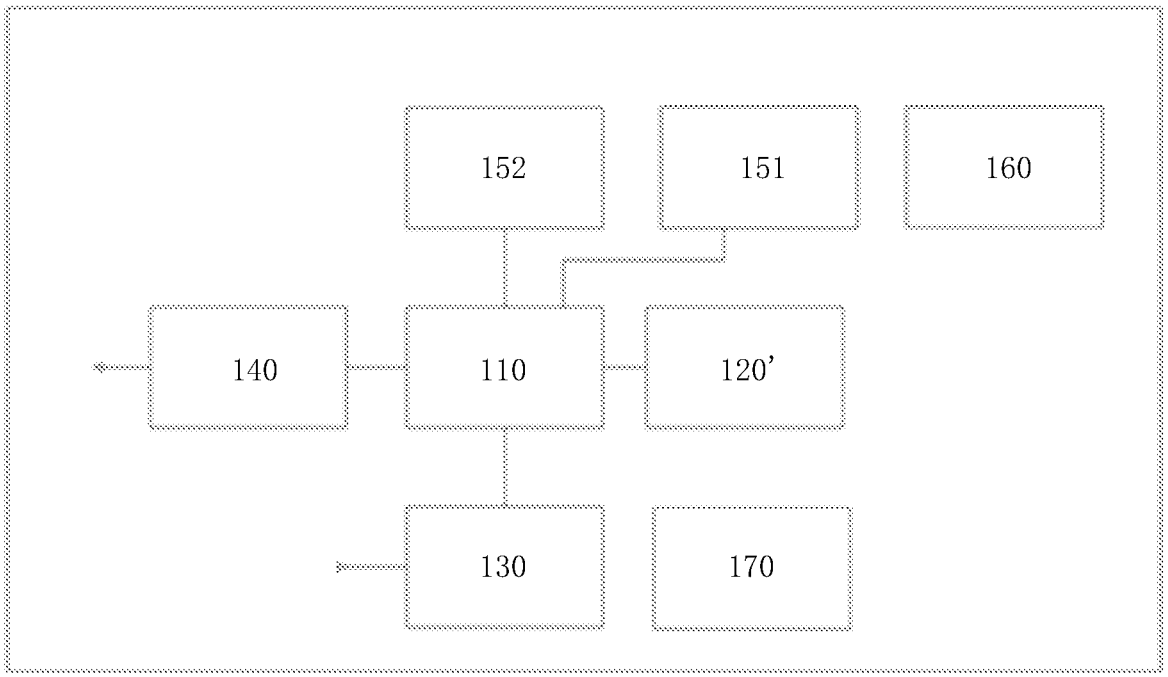
FIG. 3 is a schematic block diagram of an electrically driven fracturing apparatus with an electric motor for driving a plunger pump according to some embodiments of the present disclosure.

FIG. 3 is a schematic block diagram of an electrically driven fracturing apparatus with an electric motor for driving a plunger pump according to an embodiment of the present disclosure.

For example, referring to FIG. 3, the prime mover 120 is for example an electric motor 120'. The electric motor 120' is used as a power source and drives the plunger pump 110 to work through a transmission shaft or directly drive the plunger pump 110 to work. The fracturing apparatus includes the electric motor 120', the plunger pump 110, a high-pressure manifold system 140, a low-pressure manifold system 130, a hydraulic end lubricating system 152, a power end lubricating system 151, a cooling system 170, and a control system 160. These systems may be disposed on a chassis truck or a semitrailer or a skid chassis of steel structure, thereby facilitating the transportation of the apparatus. The electrically driven fracturing apparatus has the advantages of fewer components in the system, simple structure, low risk of the failure, and low difficulty of collaborative operation of systems.

Figure 4:
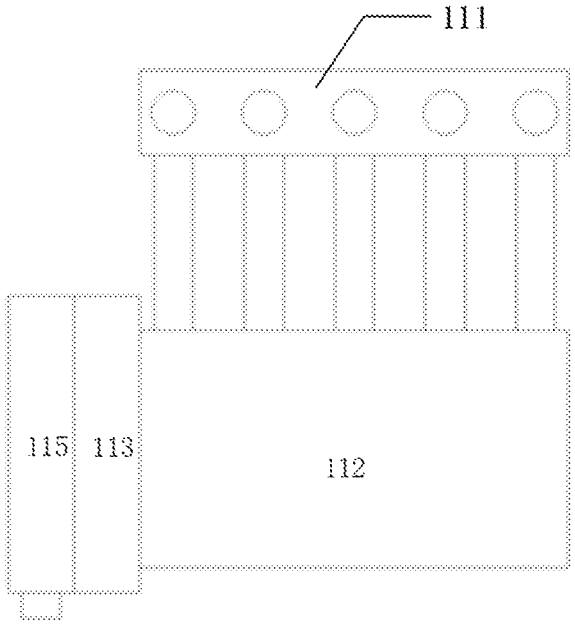
FIG. 4 is a structural schematic diagram of a plunger pump in a fracturing apparatus according to some embodiments of the present disclosure.

FIG. 4 is a structural schematic diagram of a plunger pump in a fracturing apparatus according to an embodiment of the present disclosure.

The plunger pump 110 in the fracturing apparatus provided in the embodiment of the present disclosure for example further includes a first reducer 115 and a second reducer 113 that are connected to the power end 112.

For example, the first reducer 115 is a worm gear reducer, and the second reducer 113 is a parallel reducer or a planetary reducer.

For example, the first reducer 115 and the second reducer 113 are located on the same side of the power end 112. The second reducer 113 is located between the first reducer 115 and the power end 112.

The embodiments of the present disclosure have no particular limitation on the relative positional relationship among the power end 112, the first reducer 115 and the second reducer 113.

Figure 5:
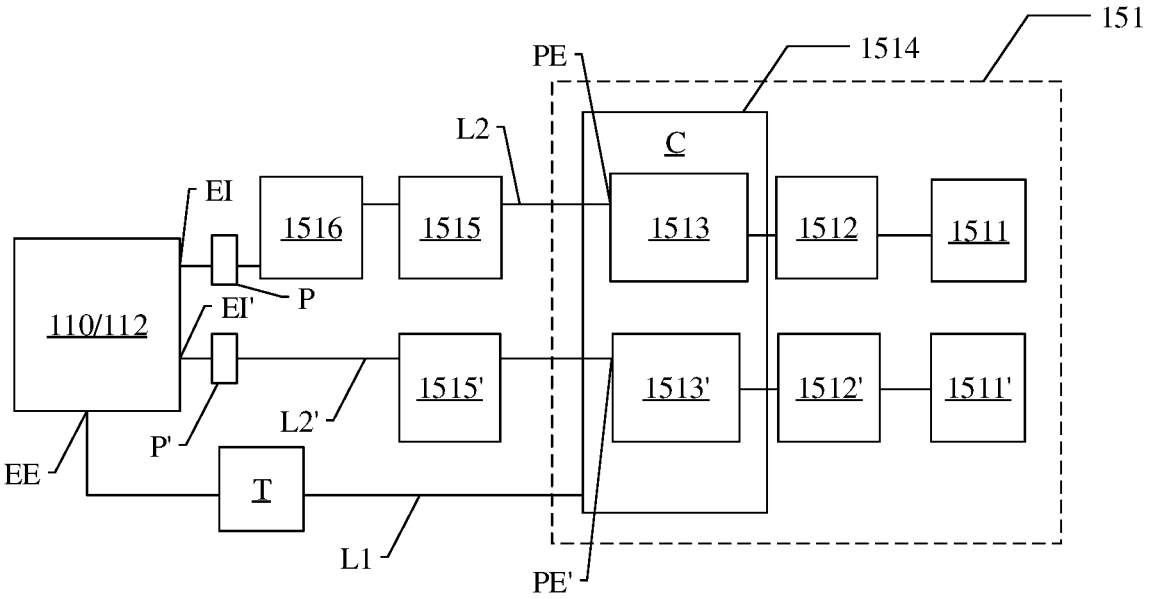
FIG. 5 is a schematic block diagram of part of an electrically driven fracturing apparatus according to some embodiments of the present disclosure.

FIG. 5 is a schematic block diagram of part of an electrically driven fracturing apparatus according to an embodiment of the present disclosure.

Referring to FIG. 5, the electrically driven fracturing apparatus includes a plunger pump 110 having a power end 112 and a power end lubricating system 151 configured to provide a lubricating oil for the power end of the plunger pump 110.

The power end lubricating system 151 includes, for example, two lubrication motors 1511 and 1511', two transmission devices 1512 and 1512', two lubrication pumps 1513 and 1513', and a lubricating oil tank 1514.

For example, the two lubrication motors 1511 and 1511' are located in the accommodation space of the lubricating oil tank 1514.

The lubrication motor 1511 provides power for the lubrication pump 1513 through the transmission device 1512 to drive the lubrication pump 1513 to operate. The oil inlet pipeline L2 is coupled to both the lubrication pump oil outlet PE of the lubrication pump 1513 and the power end oil inlet EI of the power end 112. The lubrication pump 1513 is configured to pump the lubricating oil in the accommodation space C of the lubricating oil tank 1514 to the power end 112 of the plunger pump 110 through the oil inlet pipeline L2.

The lubrication motor 1511' provides power to the lubrication pump 1513' through the transmission device 1512' to drive the lubrication pump 1513' to operate. The oil inlet pipeline L2' is coupled to both the lubrication pump oil outlet PE' of the lubrication pump 1513' and the power end oil inlet EI' of the power end 112. The lubrication pump 1513' is configured to pump the lubricating oil in the accommodation space C of the lubricating oil tank 1514' to the power end 112 of the plunger pump 110 through the oil inlet pipeline L2'.

The number of the lubrication motors and the number of the transmission devices are not limited here. Two lubrication pumps may be driven by a single lubrication motor, or two lubrication pumps may be driven by two lubrication motors, respectively. Each lubrication pump may be connected directly or through a transmission mechanism to the lubrication motor.

Furthermore, in another example, the lubrication motor, the lubrication pump and the transmission device may be disposed in the accommodation space of the lubricating oil tank, and only the lubrication pump is immersed in the lubricating oil of the lubricating oil tank.

In the electrically driven fracturing apparatus provided in the embodiment of the present disclosure, two independent lubrication loops provide lubrication oil for different components within the power end 112 of the plunger pump. One of the two lubrication loops is a high-pressure lubrication loop (in which the pressure of the lubricating oil is high), while the other one is a low-pressure lubrication loop (in which the pressure of the lubricating oil is low). The high-pressure lubrication loop is provided for the components to be lubricated with high-pressure lubricating oil in the interior of the power end 112 of the plunger pump. The lower-pressure lubrication loop is provided for the components to be lubricated with large-flow and low-pressure lubricating oil in the interior of the power end 112 of the plunger pump. With such a lubrication method, all the components in the interior of the power end of the plunger pump can be lubricated. According to different requirements of the components, desired pressures and quantities of the lubricating oil are provided, thereby effectively ensuring a normal lubricating oil temperature and sufficient lubrication of each component within the power end of the plunger pump and effectively prolonging the service life of each component.

Referring continuously to FIG. 5, the fracturing apparatus further includes a temperature detector T disposed on the oil return pipeline L1 or the power end oil outlet EE to detect the temperature of the lubricating oil flowing from the power end 112 into the oil return pipeline L1. The oil return pipeline L1 is coupled to both the power end oil outlet EE and the accommodation space C of the lubricating oil tank 1514.

The control system 160 is connected to the temperature detector T and configured to control the motors of the lubrication pumps 1513 and 1513' to keep on operating in a case where the plunger pump 110 stops operating and the temperature detected by the temperature detector T is greater than a first preset value.

With this configuration, in a case where the plunger pump stops operating, the control system may delay stopping the lubrication pump. If the temperature of the lubricating oil exceeds the first preset value, a lubricating oil heat dissipator may keep on operating, and after the temperature of the lubricating oil is lower than the first preset value, the lubrication pump and the lubricating oil heat dissipator stop operating.

Referring to FIG. 5, the fracturing apparatus provided in the embodiment of the present disclosure further includes filters 1515 and 1515' that are disposed on the oil inlet pipelines L2 and L2', respectively, and an alarm. The alarm is for example disposed on a filter core of at least one of the filters 1515 and 1515'. The control system 160 is connected to the filters 1515 and 1515' and the alarm, and configured to allow the alarm to send an alert in the case where the pressure difference across the filter core of any one of the filters 1515 and 1515' is greater than a second preset value. In this way, an operator is reminded that the filter 1515 and 1515' may have a problem when the alert is sent.

In the case where the temperature of the lubricating oil exceeds the first preset value and the alarm on the filter core sends the alert, the control system 160 controls the plunger pump 110 to stop operating. In this way, the apparatus is protected against failure due to insufficient lubrication.

The fracturing apparatus provided in the embodiment of the present disclosure further includes at least one oil pressure detector (not shown) and at least one heat dissipator 1516. The heat dissipator 1516 is disposed on the oil inlet pipeline L1 and configured to cool the lubricating oil in the oil inlet pipeline L1. In another example, a heat dissipator is further disposed on the oil inlet pipeline L1' and configured to cool the lubricating oil in the oil inlet pipeline L1'.

The at least one oil pressure detector is disposed on at least one oil inlet pipeline or the at least one power end oil inlet and configured to detect the pressure of the lubricating oil in the at least one oil inlet pipeline.

The control system 160 is connected to the at least one oil pressure detector and the at least one heat dissipator 1516 and configured to control the rotating speed of the at least one lubrication motor according to the value of the lubricating oil pressure detected by the at least one oil pressure detector and control the heat dissipation power of the at least one heat dissipator 1516 according to the value of the temperature detected by the temperature detector.

Figure 6:
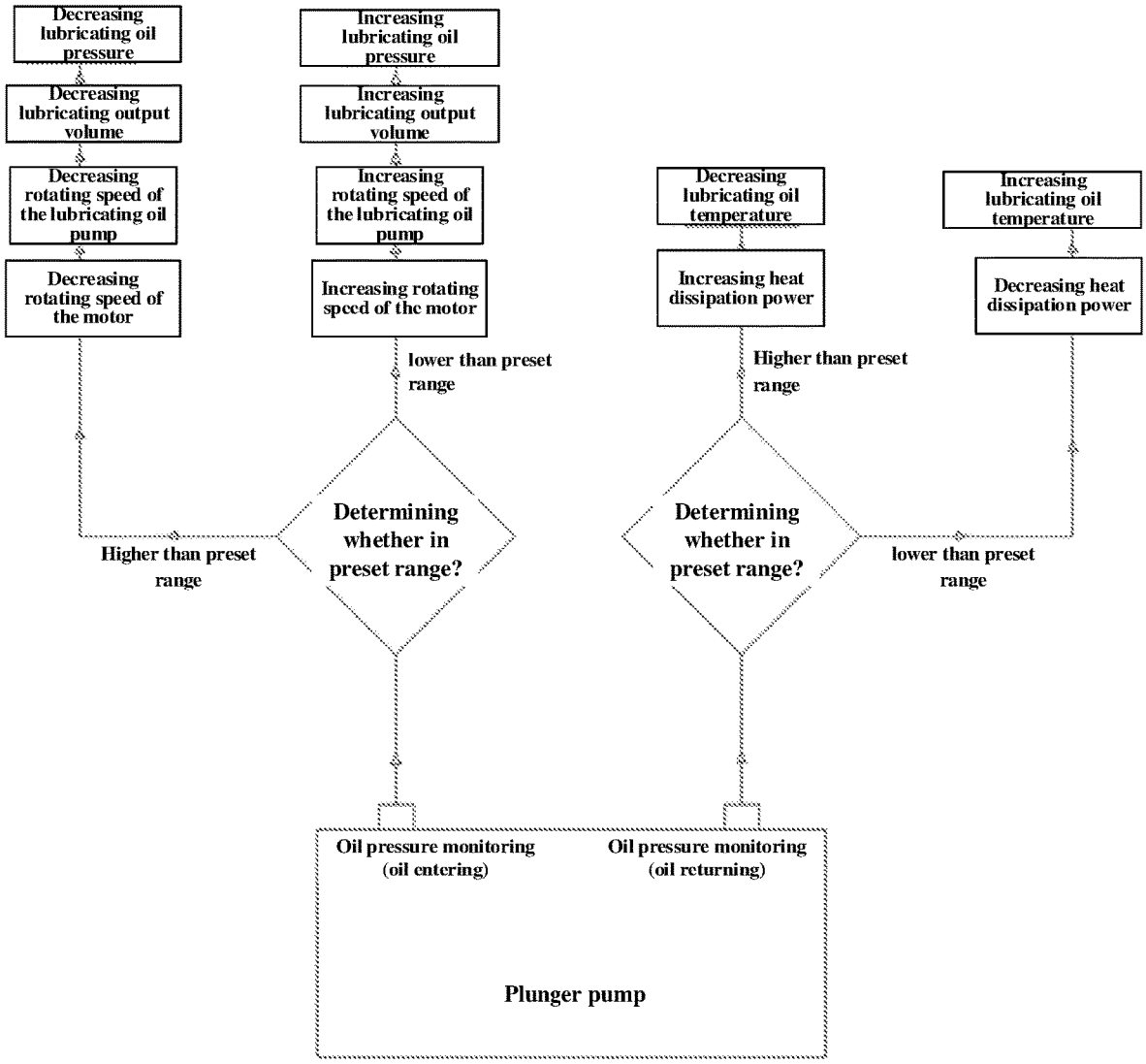
FIG. 6 is a flowchart of automatic control of a lubricating oil cooling process of a fracturing apparatus according to some embodiments of the present disclosure.

FIG. 6 is a flowchart of automatic control of a lubricating oil cooling process of a fracturing apparatus according to an embodiment of the present disclosure.

Referring to FIG. 6, in the fracturing apparatus provided in the embodiment of the present disclosure, a power end lubricating system 151 performs oil pressure monitoring on two power end oil inlets EI and EI' of a plunger pump 110 (the monitoring may be performed at the power end oil inlets EI and EI', or on oil inlet pipelines L1 and L1'). A normal working range of the lubricating oil pressure is preset. If the detected lubricating oil pressure is lower than a preset value, the control system controls the lubrication motor to increase the rotating speed of the lubrication motor such that the rotating speed of the lubrication pump is increased, the output volume of the lubrication oil and the lubricating oil pressure are increased. If the detected lubricating oil pressure is higher than a preset value, the control system controls the lubrication motor to decrease the rotating speed of the lubrication motor, such that the rotating speed of the lubrication pump is decreased, the output volume of the lubrication oil and the lubricating oil pressure are decreased. By detecting and feeding back the lubricating oil pressure, automatic control of the power end lubricating system is achieved. The control system is more intelligent, more efficient, and more energy-efficient.

In the fracturing apparatus provided by the embodiment of the present disclosure, the power end lubricating system 151 further monitors the oil temperature at the power end oil outlet EE of the plunger pump 110 (the detection may be performed on the power end oil outlet EE or the oil return pipeline L1 or the lubricating oil tank 1514). A normal working range of the oil temperature is preset. If the detected lubricating oil temperature is lower than the preset value, the control system controls the rotating speed of the lubricating oil heat dissipator to decrease until the heat dissipator stops cooling the lubricating oil. If the detected lubricating oil temperature is higher than the preset value, the control system controls the rotating speed of the lubricating oil heat dissipator to increase so as to improve the heat dissipation power for cooling the lubricating oil. Moreover, while the lubricating oil temperature increases or decreases from the corresponding preset values, the rotating speed of the lubricating motor and the heat dissipation power will increase or decrease accordingly. By detecting and feeding back the lubricating oil temperature, automatic control of the lubricating oil cooling system is achieved. The heat dissipation power is regulated as required in practice. The control system is more intelligent, more efficient, and more energy-efficient. Besides, a suitable speed may also be beneficial to reduce fan noise.

The accompanying drawings involve only the structure(s) in connection with the embodiment(s) of the present disclosure, and other structure(s) can be referred to common design(s).

In case of no conflict, features in one embodiment or in different embodiments can be combined as a new embodiment.

What is described above is related to the exemplary embodiments of the disclosure only, but the protection scope of the present disclosure is not limited to this. The protection scope of the disclosure should be defined by the accompanying claims.

What is claimed is:

1. A fracturing apparatus, comprising:

a plunger pump, comprising a hydraulic end and a power end, wherein the power end comprises a power end oil outlet and at least one power end oil inlet that are coupled to each other;

a power end lubricating system, comprising: a lubricating oil tank defining an accommodation space, at least one lubrication pump having a lubrication pump oil inlet and a lubrication pump oil outlet that are coupled to each other, and at least one lubrication motor configured to provide power for the at least one lubrication pump, wherein the lubrication pump oil inlet is coupled to the accommodation space of the lubricating oil tank, the power end oil outlet is coupled to the accommodation space of the lubricating oil tank through an oil return pipeline, the lubrication pump oil outlet of the at least one lubrication pump is coupled to the at least one power end oil inlet through at least one oil inlet pipeline;

a temperature detector disposed on any one of the oil return pipeline, the power end oil outlet, and the lubricating oil tank, and configured to detect a temperature of the lubricating oil flowing from the power end into the oil return pipeline; and a control system connected to the temperature detector and the power end lubricating system and configured to control the power end lubricating system, wherein the control system is configured to control the at least one lubrication motor to keep on operating when the plunger pump stops operating and the temperature detected by the temperature detector is greater than a first preset value.

2. The fracturing apparatus according to claim 1, wherein the lubrication pump oil inlet of the lubrication pump is directly exposed in the accommodation space of the lubricating oil tank.

3. The fracturing apparatus according to claim 1, wherein:

the power end lubricating system further comprises: at least one transmission device connecting the at least one lubrication motor to the at least one lubrication pump;

at least a portion of at least one of the lubrication motor and the lubrication pump is located in the accommodation space; and at least a portion of the at least one transmission device is located in the accommodation space.

4. The fracturing apparatus according to claim 3, wherein the accommodation space of the lubricating oil tank is configured for storing lubricating oil, and the at least one lubrication motor is configured to drive the at least one lubrication pump to deliver the lubricating oil to the power end through the at least one oil inlet pipeline.

5. The fracturing apparatus according to claim 4, wherein a portion of the at least one lubrication pump is immersed in the lubricating oil in the lubricating oil tank.

6. The fracturing apparatus according to claim 4, wherein the lubrication pump oil inlet of the at least one lubrication pump is immersed in the lubricating oil in the lubricating oil tank.

7. The fracturing apparatus according to claim 4, further comprising:

a prime mover, connected to the power end and configured to provide power for the power end, wherein the control system is connected to the prime mover and configured to control the prime mover.

8. The fracturing apparatus according to claim 7, wherein the prime mover is an electric motor.

9. The fracturing apparatus according to claim 8, wherein:

the plunger pump further comprises a first reducer and a second reducer that are connected to the power end;

the first reducer is a worm gear reducer; and the second reducer is a parallel reducer or a planetary reducer.

10. The fracturing apparatus according to claim 9, wherein:

the first reducer and the second reducer are located on a same side of the power end; and the second reducer is located between the power end and the first reducer.

11. The fracturing apparatus according to claim 1, further comprising: an alarm and at least one filter disposed on the at least one oil inlet pipeline, wherein the control system is connected to the at least one filter and the alarm and configured to send an alert when a pressure difference across a filter core of the at least one filter is greater than a second preset value.

12. The fracturing apparatus according to claim 11, wherein the control system is configured to control the plunger pump to stop operating when the temperature detected by the temperature detector is greater than the first preset value and that the alarm sends the alert.

13. The fracturing apparatus according to claim 8, wherein:

the at least one lubrication pump comprises a first lubrication pump and a second lubrication pump;

the at least one oil inlet pipeline comprises a first oil inlet pipeline and a second oil inlet pipeline;

the at least one power end oil inlet comprises a first power end oil inlet and a second power end oil inlet;

the first oil inlet pipeline is coupled to the lubrication pump oil outlet of the first lubrication pump and the first power end oil inlet;

the second oil inlet pipeline is coupled to both the lubrication pump oil outlet of the second lubrication pump and the second power end oil inlet; and the first lubrication pump and the second lubrication pump are configured with different lubricating oil pressures.

14. The fracturing apparatus according to claim 1, further comprising at least one oil pressure detector, wherein the at least one oil pressure detector is disposed on the at least one oil inlet pipeline or the at least one power end oil inlet and configured to detect a lubricating oil pressure in the at least one oil inlet pipeline.

15. The fracturing apparatus according to claim 14, further comprising at least one heat dissipator, wherein the at least one heat dissipator is disposed on the at least one oil inlet pipeline and configured to cool the lubricating oil in the at least one oil inlet pipeline.

16. The fracturing apparatus according to claim 15, wherein:

the control system is connected to the at least one oil pressure detector; and the control system is configured to control a speed of the at least one lubrication motor according to a value of the lubricating oil pressure detected by the at least one oil pressure detector.

17. The fracturing apparatus according to claim 16, wherein:

the control system is connected to the at least one heat dissipator; and the control system is configured to control a heat dissipation power of the at least one heat dissipator according to a value of the temperature detected by the temperature detector.

18. The fracturing apparatus according to claim 1, further comprising a prime mover, wherein:

the prime mover is connected to a gearbox;

the gearbox is connected to a transmission shaft;

the transmission shaft is connected to the plunger pump; and the prime mover is configured to drive the plunger pump through the transmission shaft.

19. The fracturing apparatus according to claim 1, further comprising a high-pressure manifold and a low-pressure manifold both connected to the plunger pump.

* * * * *